US005396910A

United States Patent [19]

Casey, III

[11] Patent Number: 5,396,910

[45] Date of Patent: Mar. 14, 1995

[54] CIGARETTE FILTER

[75] Inventor: William J. Casey, III, Clemmons, N.C.

[73] Assignee: R. J. Reynolds Tobacco Company, Winston-Salem, N.C.

[21] Appl. No.: 156,742

[22] Filed: Nov. 24, 1993

[51] Int. Cl.[6] ..... A24D 3/00

[52] U.S. Cl. ..... 131/336; 131/339

[58] Field of Search ..... 131/336, 365, 342, 344, 131/361, 339

[56] References Cited

U.S. PATENT DOCUMENTS

| | | | |
|---|---|---|---|
| 3,043,314 | 7/1962 | Bartolomeo | 131/336 |
| 3,045,680 | 7/1962 | Smith | 131/336 X |
| 3,199,515 | 8/1965 | Lowe et al. | 131/336 X |
| 3,744,496 | 7/1973 | McCarty et al. | 131/365 |
| 4,219,030 | 8/1980 | Hall | 131/336 |
| 4,291,711 | 9/1981 | Berger | 131/336 |
| 4,446,878 | 5/1984 | Porenski, Jr. | 131/336 |
| 4,478,229 | 10/1984 | Luke | 131/336 |

*Primary Examiner*—Jennifer Bahr

*Attorney, Agent, or Firm*—Grover M. Myers; George C. Myers, Jr.

[57] ABSTRACT

A cigarette filter connected to a tobacco rod is provided with air dilution holes which extend radially into the fibrous material of the filter to a depth of about 1.0 to about 4.0 millimeters. When a smoker draws on the cigarette, air admitted into the air dilution holes flows to a central or core region of the filter and thence to the smoker's mouth. Mainstream smoke from the tobacco rod flows into the filter and is diverted to an annular region surrounding the core region.

14 Claims, 1 Drawing Sheet

CIGARETTE FILTER

FIELD OF THE INVENTION

The present invention relates to cigarette filters and more particularly to a cigarette filter with air dilution means.

BACKGROUND OF THE INVENTION

It is well known in the cigarette filter art to provide air ventilation or air dilution means for introducing ambient air into the filter to dilute the mainstream smoke passing from the tobacco rod through the filter. As used herein, "air dilution" or "air ventilation" refers to ambient air as a diluent, and is the ratio usually expressed as a percentage, of the volume of air drawn through the air dilution means to the total volume of air and aerosol drawn through the cigarette and exiting the mouth end of the cigarette. Dilution of the mainstream smoke reduces the quantity of particulate matter and gas phase components of the smoke that is delivered to the smoker.

Ventilating air has heretofore been introduced into the filter in several ways, but primarily by the use of porous or perforated wrappers for the tobacco rod and/or filter. The most common means for introducing ventilating air into a cigarette has been by means of mechanical or laser perforations of the tipping paper and the filter plug wrap. Typically, a plurality of perforations or openings are provided in one or more rows arranged circumferentially about the filter adjacent the tobacco rod end thereof. The openings may be provided in the tipping paper and plug wrap prior to or during assembly of the cigarette.

Cigarette filters may be made with many different types of filtration materials, one of the most common materials being a rod of fibrous material, such as a cellulose acetate fiber tow. When a smoker draws on the mouth end of a cigarette with a conventional air diluted cellulose acetate filter, air flows through the air dilution openings in the tipping paper and plug wrap in a direction generally transversely to the longitudinal axis of the filter until it meets the flow of mainstream smoke from the tobacco rod. The diluting air flow is diverted by the pressure drop across the filter in a longitudinal direction toward the mouth end of the filter. In this conventional air diluted filter construction, the mainstream smoke flow is usually concentrated in a central or core portion of the filter and the dilution air flows primarily in the annular portion of the filter surrounding the central portion and between such central portion and the filter plug wrap.

Such flow of mainstream smoke and diluting air is evident from a visual inspection of the staining pattern at the mouth end of the filter. Since the dilution air forces the mainstream smoke toward the longitudinal axis of the filter, the "tar" or particulate matter in the smoke will be concentrated in the central or core portion of the filter leaving a stained or discolored core portion and an annular or peripheral portion of the filter unstained or substantially unstained. In the case of a conventional cellulose acetate filter, this flow pattern results in a concentrated stain or discoloration in the core portion of the mouth end of the filter surrounded by a white or substantially white peripheral region which does not discolor significantly as the cigarette is smoked. The greater the percentage of air dilution, the lesser the staining or discoloration in the core portion and the greater the peripheral unstained or white peripheral region.

Many factors affect the flavor and taste of cigarette smoke including filtration and air dilution. An increase in filtration efficiency (i.e., an increase in pressure drop across the filter element) or an increase in air dilution ordinarily will reduce the flavor perceived by the smoker. It would be desirable, however, to provide a filter for a cigarette which has sufficient air dilution to significantly reduce the particulate matter and gas phase components delivered to the smoker while retaining the taste and flavor of the smoke to the greatest extent possible.

SUMMARY OF THE INVENTION

It has been discovered according to the present invention that the flavor of a highly air diluted cigarette can be improved by altering the flow paths of the air and mainstream smoke through the filter. In particular, the circumferentially arranged air dilution holes or openings in the filter element are extended radially into the filter material. Ambient air is thus drawn into and flows to the mouth end of the filter through the central core region of the filter thereby forcing the mainstream smoke to flow to the mouth end of the filter through the annular or peripheral region of the filter around the core region. In this way, the mainstream smoke flows to the filter mouth end over a greater cross-sectional area of the filter than in the conventional air diluted filters. Conversely, the dilution air flows to the filter mouth end over a smaller cross-sectional area of the filter than in the conventional air diluted filters. Although the reasons are not presently understood, this alteration of the flow paths and flow path areas of the dilution air and mainstream smoke yields a filter cigarette with improved flavor and taste compared to a filter cigarette with a conventional cellulose acetate filter with equivalent air dilution.

The air dilution holes are preferably made in the filter during assembly of the filter cigarette by a conventional laser perforator, the settings of which have been adjusted to cause the laser beam to penetrate into the fibrous filter material rather than to perforate only the tipping paper and filter plug wrap as in conventional air diluted filters.

One or more circumferential rows of perforations or holes are provided in the filter plug depending on the amount of air dilution desired. Typically, at least eight holes are provided, however, the number of holes will be dependent upon the air dilution and the staining pattern desired. Air dilution may be any desired percentage up to about 85–95% with a preferred range of about 30–85% and a most preferred range of about 50–80% depending on the type of cigarette to be designed. The depth of the holes into the filter material is preferably in the range of 1.0 to 4.0 millimeters. The holes may be of any suitable cross-section (e.g., round, oval, oblong, rectangular, etc.) and the number and cross-sectional area of the holes in each row may vary depending on the amount of air dilution selected for the cigarette design. The area and depth of the holes in one row may also be different from the area and depth of the holes in another row to achieve the desired flow paths for air and mainstream smoke.

Each configuration of hole arrangements and air dilution percentage, i.e., number, depth and cross-sectional area of the holes, will yield a unique flow pattern of air and mainstream smoke for that arrangement which can be identified by the location and coloration of the staining pattern at the mouth end of the filter. These staining patterns can be helpful to identify the hole arrangements that provide the most improved taste and flavor of the cigarette.

With the foregoing and other advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
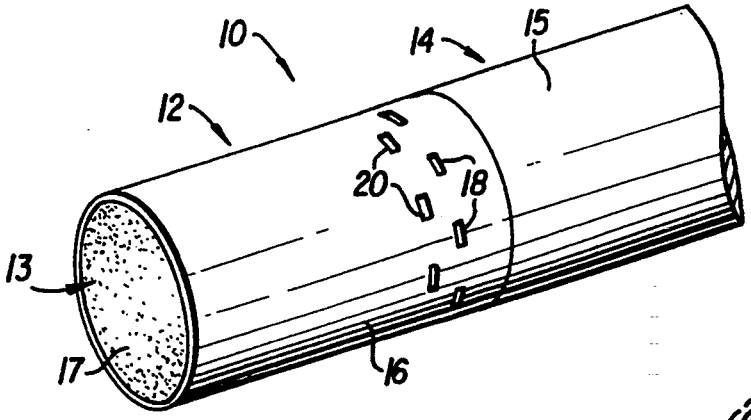
FIG. 1 is a fragmentary perspective view of a cigarette incorporating the cigarette filter of the present invention.

Referring now to the drawings there is illustrated in FIG. 1 a cigarette 10 comprising a cigarette filter 12 made according to the invention and a conventional tobacco rod 14 overwrapped by paper wrapper 15 and attached to the filter 12 by means of tipping paper 16. The filter 12 is made of a fibrous material 17, such as a polypropylene or polyester tow, but preferably a cellulose acetate tow in a conventional manner.

Two circumferential rows of radial slots or holes 18, 20 are formed in the filter adjacent the tobacco rod 14 for admitting diluting air into the filter. The holes 18, 20 are preferably formed after the tobacco rod and filter have been assembled together with tipping paper 16. The holes 18, 20 are preferably made with a conventional laser perforator set to penetrate the filter to a desired depth as described hereinafter. The number of rows, the number of holes in each row and the cross-sectional area of the holes determines the percentage of air dilution of the cigarette according to known principles.

The percentage of air dilution of a cigarette incorporating the filter of the invention may be any desired value up to about 85–95% air dilution. However, the filter of the invention is believed to be most useful for cigarettes with relatively high air dilutions, e.g., ultra low tar cigarettes with 50–80% air dilution, because such cigarettes tend to have less flavor and taste than higher tar cigarettes.

Figure 2:
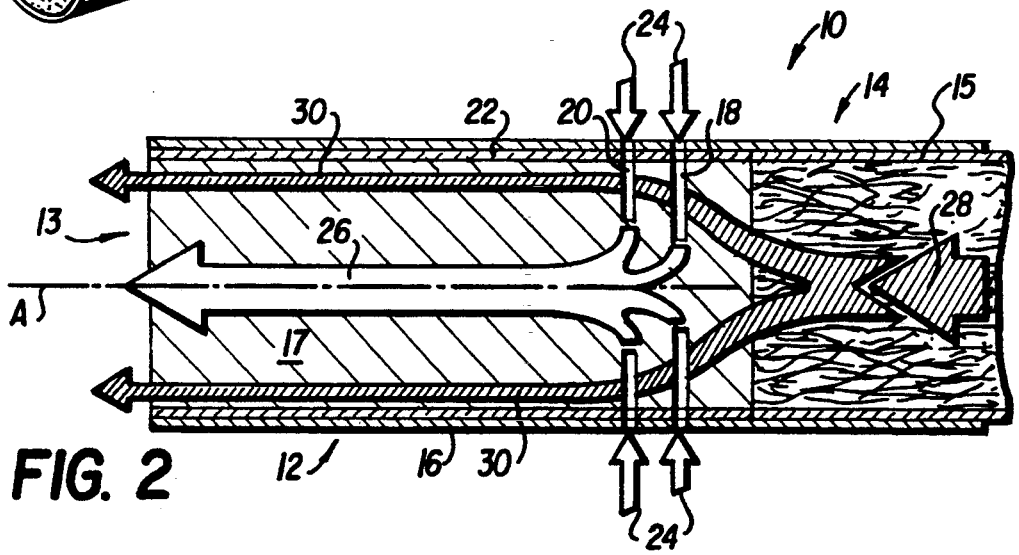
FIG. 2 is a cross-sectional view of the cigarette of FIG. 1 schematically showing the major flow paths of the dilution air and mainstream smoke.
Figure 3:
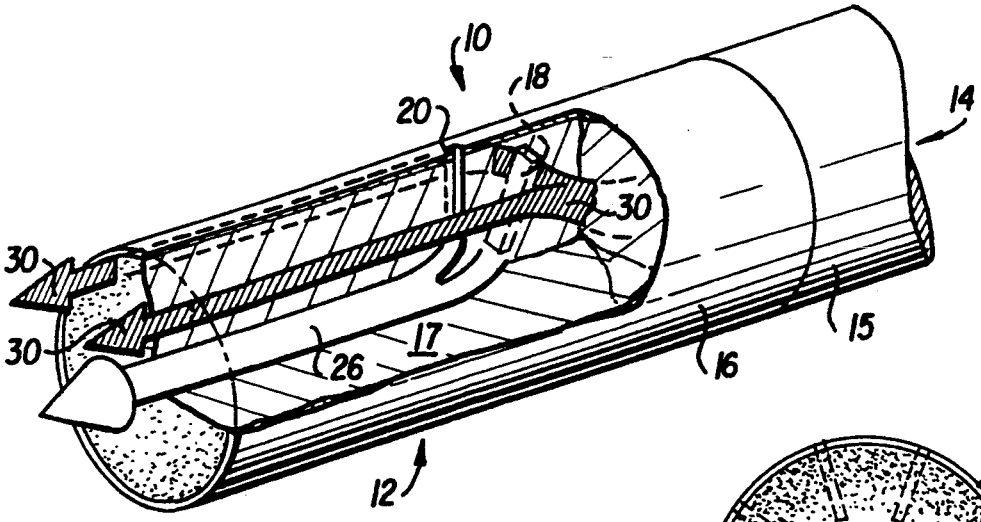
FIG. 3 is a broken perspective view of the cigarette of FIGS. 1 and 2 also schematically showing the flow paths of the dilution air and mainstream smoke.

FIGS. 2 and 3 illustrate the flow paths of the diluting air and mainstream smoke in one embodiment of the invention employing two rows of blind holes 18, 20 which extend through the tipping paper 16, the filter plug wrap 22 and into the fibrous filter material 17 to different depths. In this embodiment the holes 20 closest to the mouth end 13 of the filter 12 extend into the fibrous filter material 17 to a depth of about 2.0 millimeters and the holes 18 closest to the tobacco rod 14 extend into the fibrous filter material 17 to a depth of about 4.0 millimeters. It will be understood that the depths of the holes 18, 20 may vary from those set forth above.

When a smoker draws on the mouth end 13 of the filter 12 of cigarette 10, ambient air depicted by arrows 24 is drawn into the holes 18, 20, flows through each of the holes and exits therefrom into the fibrous filter material 17 near the longitudinal axis A of the filter. From this point, the flows from each hole combine into a large dilution air flow that travels in a generally longitudinal direction along the core portion of the filter toward the mouth end 13 as depicted by arrow 26.

Flow of the mainstream smoke through the tobacco rod 14 is depicted by arrow 28 in FIG. 2. As mainstream smoke passes into the fibrous filter 12 from the tobacco rod 14, the pressure of the dilution air in the core portion of the filter causes the mainstream smoke to diverge from the axis A and separate into a plurality of flow paths depicted generally by arrows 30. Mainstream smoke flows to the mouth end of the filter generally parallel to the flow of dilution air 26. It will be appreciated by those skilled in the art that the flows of mainstream smoke and dilution air do not separate into discrete flows as shown in FIGS. 2 and 3 for illustration purposes only by the arrows 24–30. Rather, there is some mixing and commingling of the smoke and air with a substantially greater concentration of dilution air along the central flow path depicted by arrow 26 and a substantially greater concentration of mainstream smoke along the annular flow paths depicted by arrows 30.

Figure 4:
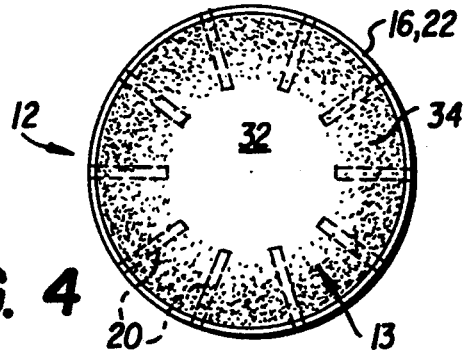
FIG. 4 is an end elevation view of the filter end of the cigarette of the present invention showing a typical staining pattern for the filter.

Referring to FIG. 4 which illustrates a typical staining pattern on the mouth end 13 of a filter constructed according to the invention, the staining pattern is depicted by a substantially clear or unstained core region 32 in the center of the mouth end and by a peripheral or annular stained region 34 surrounding the region 32.

The staining pattern and degree of discoloration shown in FIG. 4 will vary depending on a number of factors, including the percentage of air dilution (higher air dilution will result in less total discoloration than a lower air dilution), location, number and depth of the holes 18, 20. Some minor discoloration and staining may also occur in the central region 32 of the mouth end. An important feature of the invention is the redirection of a substantial portion of diluting air flow into the core region of the filter and the redirection of a substantial portion of mainstream smoke flow into the annular region surrounding the core region of the filter.

Another benefit of the present invention is possible when it is used with a specialty plug wrap such as carbon-filled paper which is used to remove gaseous phase irritants from the smoke. Since the smoke flows to the peripheral regions of the filter, there will be more reaction between the gas phase of the smoke and the plug wrap.

EXAMPLE 1

An 85 mm cigarette is prepared using an American tobacco blend having the following proportions: flue-cured 40.0%, cased burley 26.3%, Turkish 18.7%, expanded tobacco 15.0%. The cigarette has the following properties:

| | |
|---|---|
| Tobacco rod length, mm | 57.0 |
| Total cigarette length, mm | 84.0 |
| Tape circumference, mm | 24.75 |
| Total weight, g | 0.748 |
| Firmness, 0.1 mm | 9.9 |

-continued

| | |
|---|---|
| Cigarette paper | Standard |
| Tipping paper | Standard |
| Air dilution, % | 56+/−2 |
| Cigarette Pressure Drop, mm | 115+/−4 |
| Depth of holes into filter, mm | 3–4 |
| Hole location, mm from mouthend | 13 |
| Cellulose acetate tow type | 2.1/42,000 |
| Filter length, mm | 27 |
| Filter circumference, mm | 24.43 |
| Filter pressure drop, mm | 125 |
| Plasticizer, % | 8% |
| Plug wrap (non-porous) | Standard |

The holes are made in the filter by a Korber on-line laser with the following settings:

| | |
|---|---|
| Laser power, watts | 200 |
| Number of perforations | 8 |
| Pulse time setting | 115 |
| Beam control setting | 910 |

The cigarette FTC smoking yield is as follows:

| | |
|---|---|
| Number of puffs | 10.1 |
| "Tar" mg/cigarette | 6.3 |
| Nicotine mg/cigarette | 0.68 |
| CO mg/cigarette | 8.0 |
| $CO_2$ mg/cigarette | 29.0 |
| Butt length, mm | 34 |

EXAMPLE 2

An 85 mm cigarette is prepared using an American tobacco blend having the following proportions: flue-cured 35%, cased burley 21%, Turkish 18%, expanded tobacco 7%, reconstituted sheet 19%. The cigarette has the following properties:

| | |
|---|---|
| Tobacco rod length, mm | 57.0 |
| Total cigarette length, mm | 84.0 |
| Tape circumference, mm | 24.71 |
| Total weight, g | 0.95 |
| Cigarette rod wt., g | 0.734 |
| Firmness, 0.1 mm | 8 |
| Cigarette paper | Standard |
| Tipping paper | Standard |
| Air dilution, % | 84+/−1 |
| Cigarette Pressure Drop, mm | 84+/−4 |
| Cellulose acetate tow type | 2.1/42,000 |
| Filter length, mm | 27 |
| Filter circumference, mm | 24.43 |
| Filter pressure drop, mm | 125 |
| Plasticizer, % | 8% |
| Plug wrap (non-porous) | Standard |

Two rows of holes are made in the filter by a Korber laboratory laser with the following settings:

| | Row 1 | Row 2 |
|---|---|---|
| Hole location from mouth end, mm | 17 | 13 |
| Laser power, watts | 100 | 100 |
| Number of perforations | 10 | 10 |
| Pulse time setting | 198 | 198 |
| Beam control setting | 423 | 423 |
| Depth of holes into filter, mm | 1.5–3.0 | 1.3–2.0 |

The cigarette FTC smoking yield is as follows:

| | |
|---|---|
| Number of puffs | 10.3 |
| "Tar" mg/cigarette | 0.6 |
| Nicotine mg/cigarette | 0.10 |

-continued

| | |
|---|---|
| CO mg/cigarette | 1.1 |
| $CO_2$ mg/cigarette | 9.9 |
| Butt length, mm | 34 |

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A cigarette comprising a tobacco rod and a filter rod for filtering mainstream smoke from the tobacco rod, said filter rod having a tobacco rod end and a mouth end, said filter rod being made of a fibrous filter material overwrapped with a plug wrap, said filter rod having a core region extending longitudinally of the filter rod and an annular region surrounding said core region, a tipping paper connecting said tobacco rod with said filter rod, air dilution means extending into the fibrous filter material for admitting ambient diluting air into said core region of the filter rod such that the flow of dilution air is concentrated in said core region and the flow of mainstream smoke is concentrated in said annular region, said air dilution means comprising a plurality of holes located adjacent the tobacco rod end of the filter rod and extending through the tipping paper and plug wrap and into the fibrous filter material of the filter rod to a substantial depth sufficient to concentrate substantially all of the flow of diluting air in the core region of the filter rod, said filter rod being free of other air dilution flows into said filter rod so that the flow of mainstream smoke from the tobacco rod end of the filter rod through the annular region to the mouth end of the filter rod is substantially undiluted by air from the holes and substantially all dilution air admitted to the filter rod though the holes flows to the mouth end of the filter rod through the core region of the filter rod.

2. The cigarette of claim 1, wherein the depth of said holes is in the range of 1.0 to 4.0 millimeters.

3. The cigarette of claim 1, including at least eight holes.

4. The cigarette of claim 1, wherein said fibrous filter material is cellulose acetate.

5. The cigarette of claim 1, wherein said holes comprise at least two rows of holes, each hole extending radially into the fibrous material, the holes of one row having a depth greater than the holes of another row.

6. The cigarette filter of claim 5, including ten holes in each row of holes.

7. The cigarette of claim 1, wherein the amount of air dilution is in the range of about 30–95%.

8. The cigarette of claim 1, wherein said holes are laser-formed holes.

9. The cigarette of claim 1, wherein said holes have a generally oval or oblong cross-section.

10. The cigarette of claim 1, wherein the depth of said holes is about 2.0 mm or greater.

11. The cigarette of claim 1, wherein the depth of at least some of said holes is about 4.0 mm.

12. The cigarette of claim 5, wherein the holes of said one row are closest to the tobacco rod and have a depth of about 4.0 millimeters, the holes of said another row having a depth of about 2.0 millimeters.

13. The cigarette of claim 1, wherein said filter plug wrap is a carbon-filled paper.

14. The cigarette of claim 1, wherein the fibrous filter material is polypropylene or polyester.

* * * * *